US006006485A

United States Patent [19]

Hobbs et al.

[11] Patent Number: 6,006,485

[45] Date of Patent: Dec. 28, 1999

[54] BUILDING CONSTRUCTION ASSEMBLY AND SUPPORT CLIP THEREFOR AND METHOD

[75] Inventors: Bobby E. Hobbs, Winchester; Jeffrey L. Perdue, Beattyville, both of Ky.

[73] Assignee: KY Truss, Inc., Beattyville, Ky.

[21] Appl. No.: 08/501,359

[22] Filed: Jul. 12, 1995

[51] Int. Cl.[6] ..... E04B 1/32

[52] U.S. Cl. ..... 52/489.1; 52/90.1; 52/93.1; 52/643; 52/702

[58] Field of Search ..... 52/489.1, 479, 52/404.3, 665, 668, 729.1, 745.13, 235, 639, 90.1, 93.1, 643, 702

[56] References Cited

U.S. PATENT DOCUMENTS

| | | | |
|---|---|---|---|
| 2,511,584 | 6/1950 | Hill | 249/93 X |
| 2,989,154 | 6/1961 | Colby . | |
| 3,209,503 | 10/1965 | Mostoller | 52/478 X |
| 3,343,321 | 9/1967 | Axelsson . | |
| 4,007,570 | 2/1977 | Hunter | 52/665 X |
| 4,121,391 | 10/1978 | Schroeder | 52/235 |
| 4,887,406 | 12/1989 | Saia | 52/729.1 X |
| 4,894,964 | 1/1990 | Thrift et al. | 52/745.13 X |
| 5,216,858 | 6/1993 | Gilmour | 52/665 X |

FOREIGN PATENT DOCUMENTS

| | | | |
|---|---|---|---|
| 0137341 | 6/1991 | Japan | 52/235 |

*Primary Examiner*—Winnie S. Yip
*Attorney, Agent, or Firm*—Jack E. Toliver

[57] ABSTRACT

A building construction assembly comprises a plurality of vertical columns that cooperate with a plurality of horizontal beams to collectively define a substantially planar frame border of a building. The vertical columns are in the form of upright trusses having a first upstanding member formed with a pair of angle irons. Each of the angle irons has a first projecting leg and a second projecting leg. The first projecting legs extend inwardly relative to the border in spaced parallel relation and the second projecting legs extend in opposite directions along a common line. A support clip is attached to the first upstanding member for supporting an associated horizontal beam in such a position that the outer facing surfaces of the horizontal beam and the first upstanding member defines the substantially planar border. The support clip is defined by a plate for supporting the associated horizontal beam and a load-bearing flange for retaining the horizontal beam. A cut-out portion is formed in the support clip for receiving the laterally projecting legs of the first upstanding member for attachment. The support clip is properly oriented on the first upstanding member to support the horizontal beam in functional manner.

10 Claims, 4 Drawing Sheets

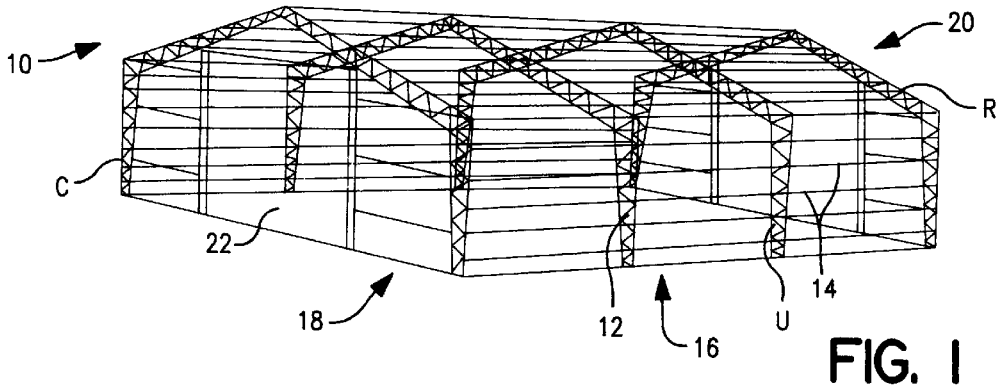
FIG. 1
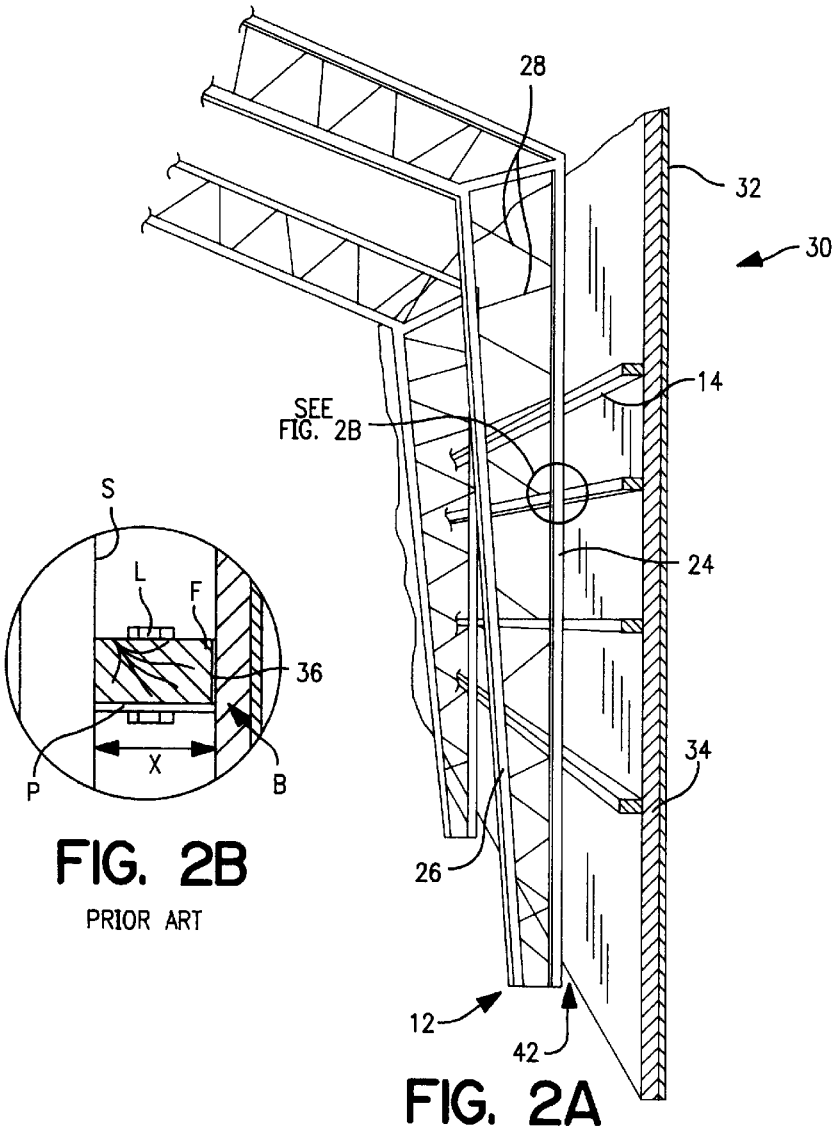
FIG. 2B
PRIOR ART
FIG. 2A

BUILDING CONSTRUCTION ASSEMBLY AND SUPPORT CLIP THEREFOR AND METHOD

TECHNICAL FIELD

The present invention relates generally to building construction. More particularly, a building construction assembly with novel components is disclosed that beneficially causes a reduction in material requirements. The building construction assembly results in greater usable internal area within the fully completed structure relative to a frame of given size. The invention also contemplates the practice of a method for achieving the desired results.

BACKGROUND OF THE INVENTION

An early stage in the construction of a building involves erecting a framework upon which siding or sheathing is applied to form the exterior, and insulation and, in most cases, drywall is applied to create the interior.

The majority of residential structures are constructed with wooden boards known in the art by the convention detailing the thickness and width dimensions, such as 2×4. The boards generally form the vertical columns and horizontal beams (known to artisans as girts) of the building frame. Some smaller sized non-residential structures, such as barns, storage buildings and warehouses, are also likewise constructed.

Steel has become a popular alternative to wood as a building material. It is often used to frame commercial buildings like those mentioned above. With price of wood rising rapidly and the quality of structural lumber declining, an increasing number of steel-framed residential structures are being erected on an annual basis.

The vertical columns in a steel-framed building most often take the form of trusses. More particularly, each column is defined by two upstanding members that are connected by braces welded to and extending between the upstanding members to provide strength and support.

In present truss frame assemblies, the horizontal beams are supported by brackets on the outer facing surfaces of the upright trusses. Therefore, the true frame boundary is defined by the outer facing surfaces of the horizontal beams. It is thus recognized that the amount of siding or sheathing needed for the finished building is based on the distance between the outer facing surfaces of the horizontal beams on the opposing sidewalls and the opposing endwalls.

Considered in a different way, the upright trusses are inset on the building foundation from the exterior walls. Since the positions of each truss determines the placement of the internal walls of the structure, one can visualize the availability of an additional amount of usable interior area in the building if the trusses were not inset on the foundation.

Since building construction is an expensive undertaking, a small reduction in material requirements or, viewed alternatively, an increase in usable interior area for a given frame size, can result in significant cost savings and/or greater asset value. Thus, there is a need for a building construction assembly, and a method of building construction, that achieves the desired results.

SUMMARY OF THE INVENTION

It is, therefore, an object of the present invention to provide a building construction assembly that provides increased usable interior area, relative to a frame of a given size, once it is completed.

It is another object of the present invention to provide a building construction assembly that facilitates a reduction in construction material for a structure having a preselected amount of usable interior area upon completion.

An additional object of the present invention is to provide an improved technique of positioning the horizontal beams of a building framework.

Still another object of the present invention is to provide support clips for attaching to each of the vertical columns of a building frame to support, between an adjacent pair, an associated horizontal beam in such an manner that the outer facing surfaces of the columns and beam together form a substantially planar frame border of a building.

It is still another object of the present invention to provide an improved method of building construction that results in cost savings and increased property value.

It is a further object of the present invention to provide a truss frame building that is easily and efficiently erected.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a building construction assembly is provided that advantageously increases the usable internal area of a building relative to a frame of the given size. The building construction assembly comprises a plurality of spaced vertical columns, each of the columns having a outer facing surface. The outer facing surfaces on an adjacent pair of vertical columns defines a common vertical plane.

A plurality of horizontal beams is provided to cooperate in an advantageous manner with the spaced vertical columns. Each of the horizontal beams has an outer facing surface and are grouped into sets for operable use. Each set of horizontal beams extends between a different adjacent pair of vertical columns. The outer facing surfaces of the horizontal beams associated with the respective adjacent pair of vertical columns are positioned to be substantially aligned with the common vertical plane defined by the outer facing surfaces of vertical columns. Thus, upon assembly, the outer facing surfaces of the adjacent pair of vertical columns and associated horizontal beams together form a substantially planar frame border for the building.

In one of the key aspects of the invention, a support clip is attached to each of the vertical columns for supporting an associated one of the horizontal beams in the required position to form, collectively with the vertical columns, the substantially planar border of the building.

The preferred embodiment of the inventive building construction assembly contemplates the use of upright trusses as the vertical columns. More specifically, the vertical columns each comprise a first upstanding member extending in a substantially vertical direction. This first upstanding member includes the outer facing surface of the vertical column. A second upstanding member is spaced inwardly of the first upstanding member relative to the border and extends to a height no higher than the first upstanding member. A plurality of braces extend between and connect the first and second upstanding members to provide stability and strength for the vertical column. For certain trusses, the second upstanding member of a group of vertical columns extends upwardly at an oblique angle relative to the first upstanding member.

The first upstanding member preferably comprises a pair of spaced angle irons. Each angle iron has a first projecting leg and a second projecting leg that meet perpendicularly to form a corner. The first projecting legs of the angle irons extend inwardly relative to the border in spaced parallel relation from their respective corners. The second projecting legs extend in opposite directions from their respective corners along a common line.

In the preferred embodiment of the invention, each of the first projecting legs of the angle irons includes an abutment surface and a brace attachment surface. The spaced planar relation of the first projecting legs of the individual angle irons define an alley between the respective brace attachment surfaces for receiving the braces for attachment. The inventive building construction assembly further contemplates that each of the second projecting legs of the angle irons includes a contact surface and a border surface. The border surfaces of the second projecting legs coincide with the outer facing surface of the vertical column and define the substantially planar frame border of the building. With this design, the support clip is attached to the first projecting legs of the angle irons, preferably to the abutment surfaces thereof.

As described above, the support clip promotes the advantageous relative positioning of the vertical columns and horizontal beams of the building construction assembly and is preferably defined by a plate for supporting the associated horizontal beam and a load-bearing flange for retaining the beam. The plate and the flange desirably meet perpendicularly to form a fillet. The preferred clip design further includes a cut-out portion for receiving the first projecting legs of the angle irons for attachment. In one embodiment of the support clip, the cut-out portion is formed at an edge of the plate opposite the flange. When this embodiment of the support clip is in use, the first projecting legs of the angle irons extend into the cut-out portion and the clip is oriented so that the flange projects upwardly from the fillet.

In an alternative embodiment of the support clip, the cut-out portion is formed adjacent to, and extending along the plate a distance from, the fillet. The cut-out is further formed through the fillet and through the flange to define first and second flange portions. When this alternative embodiment of the support clip is employed, the first projecting legs of the angle irons extend into the cut-out portion and the clip is oriented so that the first and second flange portions project downwardly adjacent the contact surfaces of the second projecting legs of the angle irons.

The present invention further resides in a clip that is usable in building construction for attaching to a vertical column and for supporting an associated horizontal beam. The support clip comprises a plate for supporting the horizontal beam and a load-bearing flange for retaining the beam. The preferred embodiment of the clip includes a cut-out portion formed in the plate for receiving the vertical column for attachment. The novel support clip design allows the horizontal beam to be supported in a position adjacent the vertical column to form, collectively with the vertical column, a substantially planar frame border for a building.

The desired configuration of the support clip has the plate and the flange meeting perpendicularly to form a fillet. There are a number of design variants considered within the scope of the inventive support clip. In one version, the cut-out portion is formed at an edge of the plate opposite the flange. This embodiment of the support clip is attached for the vertical column such that the vertical column is received within the cut-out portion and the clip is oriented so that the flange projects upwardly from the fillet.

An alternative design for the support clip contemplates the cut-out portion being formed adjacent to, and extending along the plate a distance from, the fillet, and is further formed through the fillet and through the flange to define first and second flange portions. When this embodiment is in operative position, the vertical column extends within the cut-out portion and the clip is oriented so that the first and second flange portions project downwardly adjacent the vertical column.

The present invention also exists in a novel method of building construction that achieves the goal of increasing the usable internal area of a building relative to a given external boundary of the building. In practicing the inventive method, a plurality of vertical columns, each having an outer facing surface, are positioned in spaced horizontal relation such that the outer facing surface of each of an adjacent pair of the vertical columns defines a common vertical plane. A set of horizontal beams, each also having an outer facing surface, is positioned in spaced vertical relation between an adjacent pair of vertical columns. The set of horizontal beams is placed to allow their outer facing surfaces to substantially align with the common vertical plane defined by the outer facing surfaces of the adjacent pair of vertical columns.

The steps of positioning the horizontal beams is repeated for each additional set of horizontal beams that is to be positioned between remaining adjacent pairs of vertical columns. The inventive method thus allows the outer facing surfaces of the vertical columns and horizontal beams to be positioned in a manner so that together they form a substantially planar frame border for the building.

In one of the significant aspects of the inventive method, a further step of attaching a support clip to each of the vertical columns for supporting an associated horizontal beam is employed. This step facilitates the retention of the associated horizontal beam in a position such that the outer facing surfaces of the horizontal beams and the vertical columns form, collectively, the substantially planar border.

As part of the preferred embodiment of the method, vertical columns having a preferred functional design are provided to promote the formation of the building frame. Each of the vertical columns includes a first upstanding member extending in a substantially vertical direction. The first upstanding member includes the outer facing surface of the vertical column. The vertical column further includes a second upstanding member spaced inwardly of the first upstanding member relative to the frame border and extending to a height no higher than the first upstanding member. The vertical column also is provided with a plurality of braces extending between and connecting the first and second upstanding members.

In the preferred embodiment of the building construction method, the first upstanding members that are provided as part of the vertical column each include a pair of spaced angle irons. Each angle iron has a first projecting leg and a second projecting leg that meet perpendicularly to form a corner. In practicing the method, the angle irons are positioned such that the first projecting legs extend inwardly relative to the frame border in spaced parallel relation from their respective corners. This positioning further directs that the second projecting legs of the angle irons extend in opposite directions from their corners along a common line. With this preferred embodiment of the novel method, the support clip attaching step comprises attaching the clip to the first projecting legs of the angle irons.

In another important aspect of the inventive method, support clips having an important functional purpose are provided and are defined by a plate for supporting the associated horizontal beam, a load-bearing flange for retaining the horizontal beam and a cut-out portion on the plate. When attaching the support clip as part of the method, the cut-out portion is placed for engagement with an attachment to the first projecting legs of the angle irons. The support clips that are provided also preferably are designed such that the plate and flange meet perpendicularly to form a fillet.

It is further contemplated that the support clips provided for use in one embodiment of the inventive method have a cut-out portion formed at an edge of the plate opposite the flange. The support clip attaching step using this clip design involves extending the first projecting legs of the angle irons into the cut-out portion and orienting the clip such that the flange projects upwardly from the fillet.

A second embodiment of the method contemplates providing a support clip including the cut-out portion formed adjacent to, and extending along the plate a distance from, the fillet, and further formed through the fillet and through the flange to define first and second flange portions. The support clip attaching step in this second embodiment of the building construction method entails extending the first projecting legs into the cut-out portion of the support clip and orienting the clip such that the first and second flange portions project downwardly adjacent the second projecting legs.

Still other objects of the present invention will become apparent to those skilled in this art from the following description wherein there is shown and described a preferred embodiment of this invention, simply by way of illustration of one of the modes best suited to carry out the invention. As will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing, incorporated in and forming a part of the specification, illustrates several aspects of the present invention and, together with the description, serves to explain the principles of the invention. In the drawing:

FIG. 1 is a perspective view of the frame of a building constructed with cooperating vertical columns and horizontal beams;

FIG. 2 is a perspective view of a prior art building construction wherein the horizontal beams are attached to and positioned exteriorly of the outer facing surfaces of the vertical columns of the building frame;

Figure 3B:
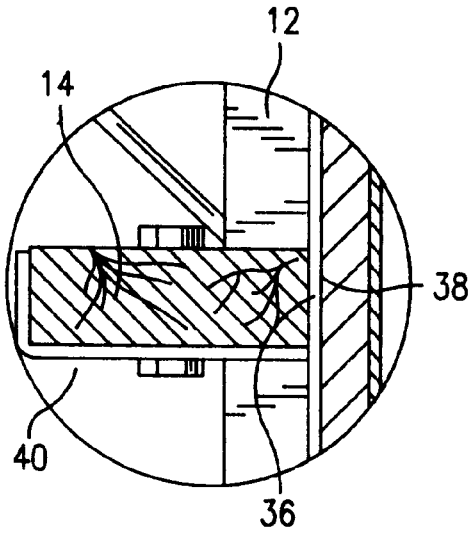
FIG. 3 is a perspective view of the building construction assembly of the present invention wherein the horizontal beams are positioned so that the outer facing surfaces of the vertical columns and horizontal beams together form a substantially planar frame border of the building.

Reference will now be made in detail to the present preferred embodiment of the invention, an example of which is illustrated in the accompanying drawing.

DETAILED DESCRIPTION OF INVENTION

Building construction comprises the interim stage of erecting a frame to form the rigid body of a building. FIG. 1 illustrates a building frame 10 that typically may be finished into a warehouse. The building frame 10 is one that is readily suited to construction using the principles of the present invention.

The frame 10 comprises a building construction assembly broadly defined by a plurality of vertical columns 12 and a plurality of horizontal beams 14 that are cooperatively connected to create the rigid structure. The horizontal beams 14 are commonly referred to in the art as girts, but will continue to be referred to hereinafter as horizontal beams for consistency of understanding. The frame 10 defines opposing sidewalls 16 and opposing endwalls 18. A roof 20 is framed to connect the opposing sidewalls 16 over the top of the structure. The particular building in FIG. 1 is constructed to have a large door 22 in each of the endwalls 18.

While the building frame 10 shown in FIG. 1 is rectangular, the invention may be used in constructing buildings having other rectilinear geometric shapes. Consequently, it is important to consider broadly the linear relation between an adjacent pair of vertical columns 12 and the set of horizontal beams 14 that extend between them.

The illustrated frame 10 is generally known in the art as a truss frame. More specifically, the vertical columns take the form of upright trusses U, each of which connects at its upper end to a roof truss R. The upright trusses U primarily serve as the erect support members for only the sidewalls 16. The corner upright trusses are identified by the letter C for description purposes offered in more detail below. Hereinafter, again in the expectation of consistency, either type of upright trusses U, C will be referred to by the general term vertical column 12.

Figure 3A:
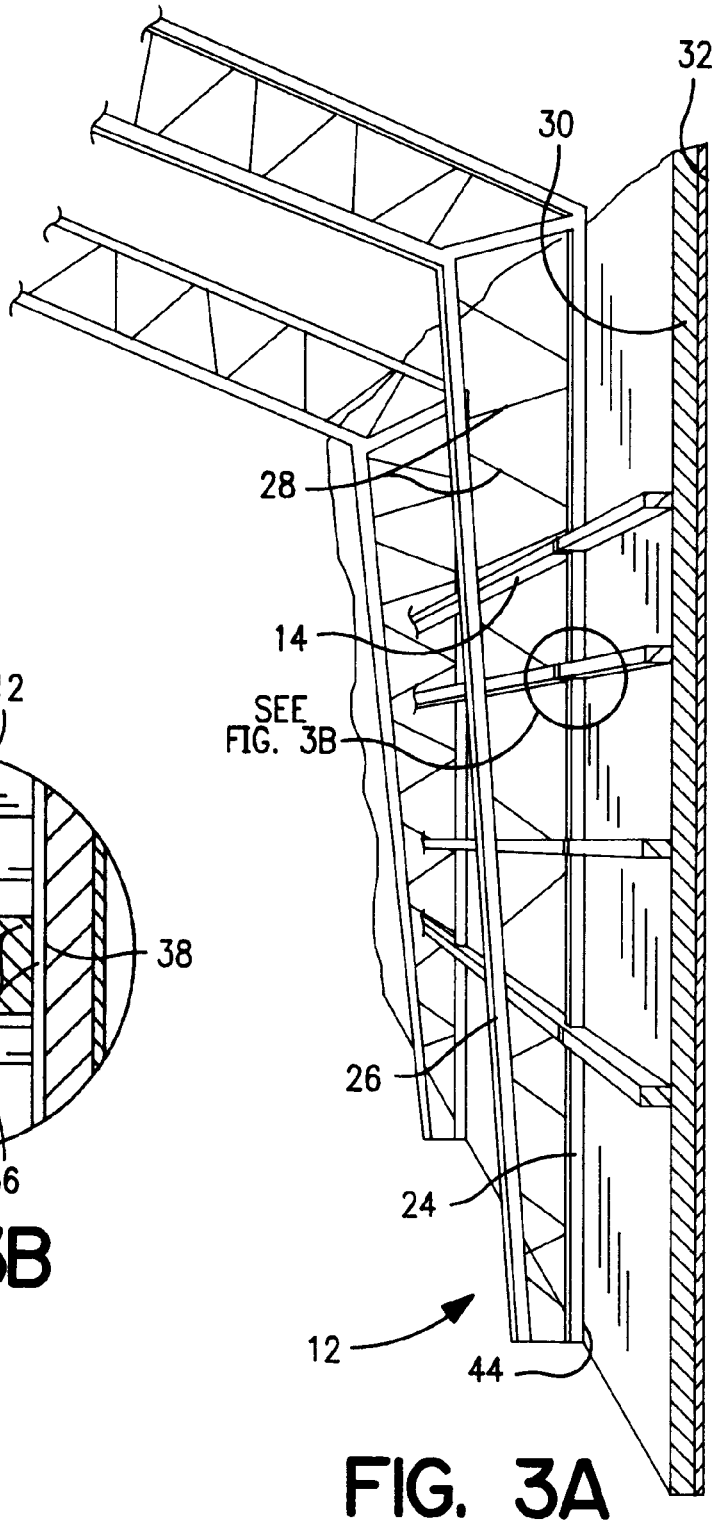

In accordance with conventional principles, the preferred embodiment of the vertical column is designed to have a first upstanding member 24 that is placed to extend in a substantially vertical direction. The vertical column 12 further includes a second upstanding member 26 that is positioned inwardly (relative to the building wall) of the first upstanding member 24. As best seen in FIGS. 2 and 3, both showing a similar collection of vertical columns 12, the second upstanding member 26 extends upwardly at an oblique angle relative to the first upstanding member 24. In order to properly join the vertical column 12 with the roof truss R, the second upstanding member 26 typically rises to a height no higher than the first upstanding member 24.

A plurality of braces 28 are attached to both of, and connect, the first and second upstanding members 24, 26. The braces 28 provide stability and strength for the vertical columns 12 of the frame 10. Since the roof trusses R and related components form no part of the inventive building construction assembly and the method of its application, no further mention is made with respect to these elements.

A comparison of FIGS. 2 and 3 provides ample proof of the differences between the present invention and the prior art design. More specifically, the prior art design depicted in FIG. 2 shows the horizontal beams 14 positioned exteriorly of the first upstanding member 24 of the vertical columns 12. As seen in the detailed inset, the horizontal beam 14, in this case a 2×4, is supported outside of and against the outer facing surface S of the first upstanding member 24 by a support bracket B. The support bracket B typically has a plate P attached to the outer facing surface S of the first upstanding member 24 and a flange F for supporting and retaining, respectively, the horizontal beam 14 in position. A lag screw L may also be employed to secure the beam 14 against movement.

The exterior wall 30, defined by outer cladding 32 and ah inner layer of insulation 34, is set against the retaining flanges F of all of the support brackets B attached to the substantially vertical first upstanding member 24. Taking into account the thin dimension of the flange F as compared to the width of the horizontal beam 14, the frame border of the prior art building frame is substantially defined by the outer facing surfaces (identified by numeral 36) of the horizontal beams alone. The outer facing surfaces S of the vertical columns 12 are therefore not associated with the frame border.

In contrast, the inventive building construction assembly provides for different relative positioning between the vertical columns 12 and the horizontal beams 14 as shown in FIG. 3. More specifically, with reference to the inset for detail, the horizontal beams 14 are positioned interiorly of the outer facing surface (identified by numeral 38) of the first upstanding members 24 of the vertical columns 12. In this position, the outer facing surfaces 36 of the horizontal beams 14 are substantially aligned with the outer facing surfaces 38 of the first upstanding members 24 of the vertical columns 12. Therefore, again disregarding the relatively thin dimension of the bordering component of the first upstanding member 24, the frame border for the building frame 10 is substantially defined by the outer facing surfaces 36 of the horizontal beams 14 and the outer facing surfaces 38 of the vertical columns 12 in combination. This configuration associated with the inventive building construction assembly is preferably achieved with the use of a unique support clip 40 as is further described below.

The relative positioning of the vertical columns 12 and horizontal beams 14 in accordance with the building construction assembly of the present invention yields significant benefits. Referring again to FIG. 2 illustrating the prior art design, the inset identifies the distance exteriorly of the outer facing surface S that the horizontal beam 14 extends as X, which is essentially the width of the beam. It can be recognized that the same physical scheme occurs with respect to the opposing sidewall. Accordingly, since the frame border of each sidewall is defined by the outer facing surfaces 36 of the horizontal beams 14, the length of each endwall when completed is determined by adding the distance 2× to the distance between the outer facing surfaces S of opposing vertical columns 12.

Using the inventive building construction assembly, the exterior wall 30 (again shown with outer cladding 32 having an inner layer of insulation 34) is built directly adjacent to the outer facing surfaces 38 of the first upstanding members 24. Assuming the same size frame 10 is constructed using the inventive building construction assembly, the finished building has endwalls 18 each of a length limited to the distance between the outer facing surfaces 38 of the horizontal beams 14, i.e. shorter by the distance 2× as compared with the prior art design. Artisans will recognize that overall reduction in material requirement for completing a building constructed using the inventive building construction assembly is related to a dimension equal to 8× (the extra length for each of endwalls and sidewalls of the prior art structure).

As a result of this recognition, it becomes apparent that the present invention promotes cost reduction by reducing the amount of material required for completing the building. Due to the cost of construction material, those skilled in the art can appreciate the significant economic advantage that is brought about by the material reduction achieved by the present invention.

As an additional consideration, since the interior walls of the building are finished in accordance with the placement of the second upstanding members 26 of the vertical columns 12, one can envision that the use of building construction assembly of the present invention produces greater usable internal area than the building finished upon a frame of equivalent size of the prior art design. It is important to note here that the size of the frame is considered to be defined by the frame border. With the prior art design, the frame border exists at the outer facing surfaces 36 of the horizontal beams 14. With the inventive building construction assembly, the frame border is defined by the combination of the outer facing surfaces 36 of the horizontal beams 14 and the outer facing surfaces 38 of the vertical columns 12, since they are in substantial alignment as described above.

Thus, for a frame of equivalent size, the inventive building construction assembly allows the vertical columns 12 to be moved outwardly to be in closer proximity to the later finished exterior wall 30. Since the vertical column 12 is positioned closer to the exterior wall 30, the distance between the exterior wall 30 and the finished interior wall is reduced. This can be visualized by comparing the open space 42 between the layer of insulation 34 and the first upstanding member 24 in the prior art design (see FIG. 2) and the flush juxtaposition 44 of these two elements with reference to the inventive building construction assembly (see FIG. 3). The natural result is in an increase in the usable internal area of the finished building.

Figure 4A:
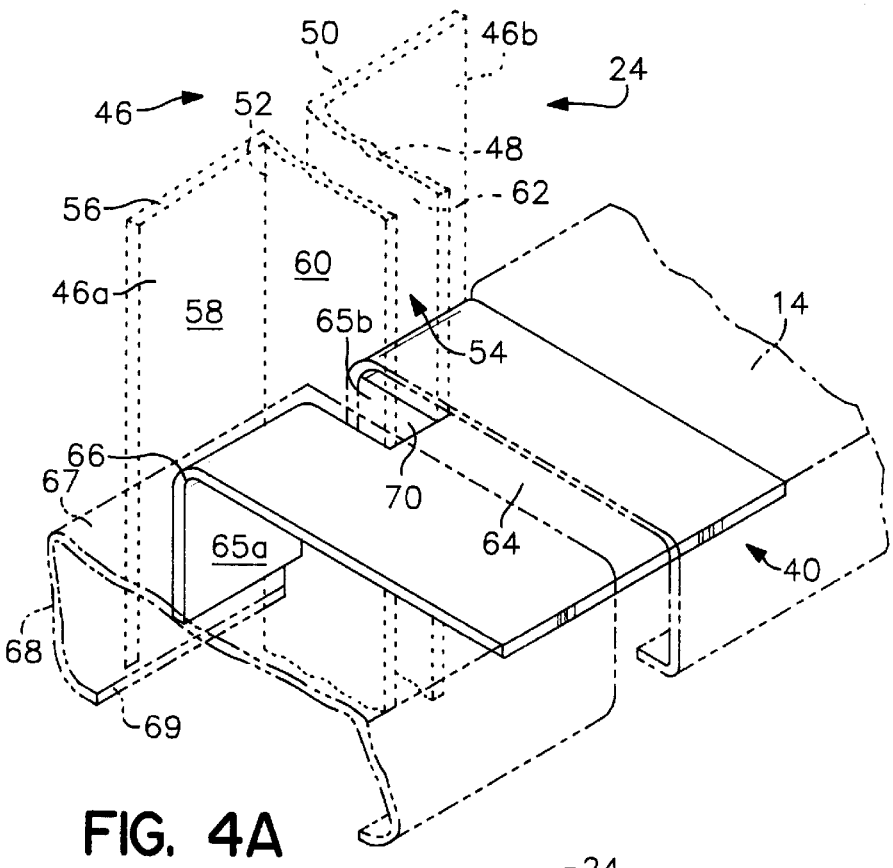
FIG. 4A shows an embodiment of the support clip in operative position for supporting and retaining metal extension-type horizontal beams.
Figure 4B:
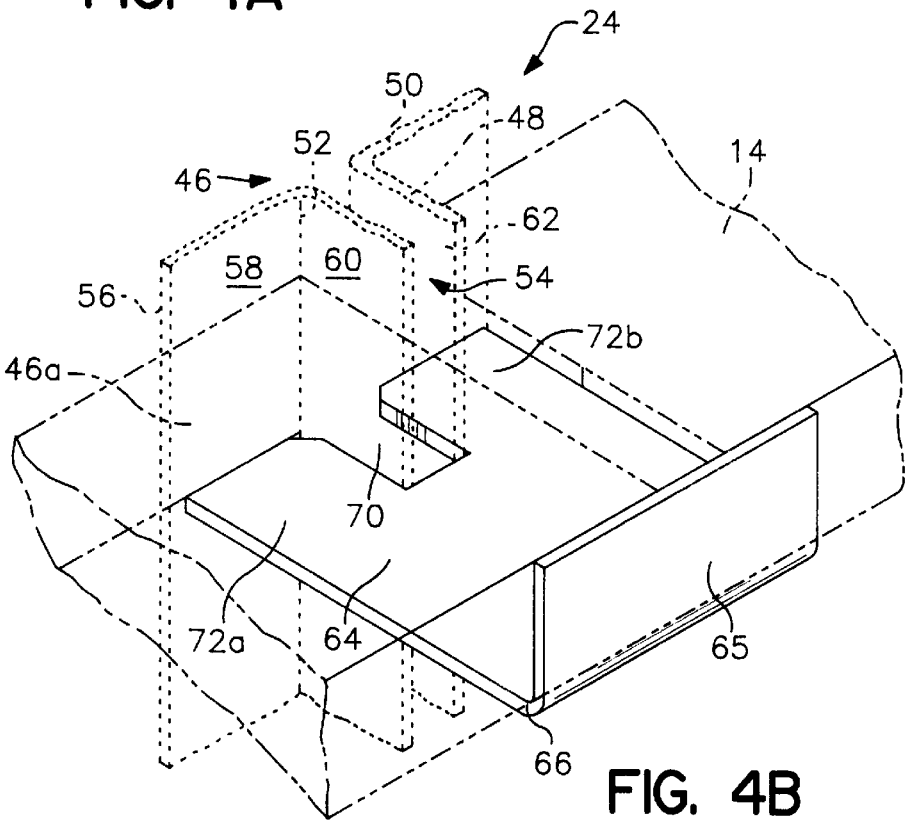
FIG. 4B shows an embodiment of the support clip in operative position for supporting and retaining wood-type horizontal beams.

The support clip 40 that assists in achieving the very beneficial effects of the present invention is attached to the vertical column 12 and supports and retains an associated horizontal beam 14. Details of the inventive support clip 40 are illustrated in FIGS. 4A and 4B, showing alternative embodiments of clip. Both embodiments cooperatively attach to the first upstanding member 24, but in different orientations for supporting different types of horizontal beams 14. These drawing figures also illustrate the details of the preferred variant of the first upstanding member 24, shown in phantom as a pair of spaced angle irons 46. For purposes of differentiation, the leftmost angle iron in the drawing figures is identified as 46*a,* and the rightmost angle iron is identified as 46*b,* while collectively they will continue to be referred to as 46. Each angle iron 46*a,* 46*b* has a first projecting leg 48 and a second projecting leg 50.

As is customary with angle irons, the first projecting leg 48 and the second projecting leg 50 meet perpendicularly to form a corner 52. The angle irons 46 are positioned for use such that the first projecting legs 48 are in spaced parallel relation, defining an alley 54 therebetween, and project inwardly with respect to the frame border from their respective corners 52. The second projecting legs 50 extend from their respective corners 52 in opposite directions along a common line.

The common line along which the second projecting legs 50 extend is defined by a border surface 56 on each leg. In accordance with the principles of the inventive building construction assembly, the border surfaces 56 of the pair of angle irons 46 define the outer facing surface 38 of the first upstanding member 24, and thus form a part of the frame border of the building under construction.

The opposite surface of the second projecting leg 50 is defined as a contact surface 58. The contact surface 58 presents itself for contact by the horizontal beams 14. In so doing, the horizontal beam 14 is retained against outward movement by the contact surface 58.

The first projecting legs 48 are each defined by an abutment surface 60 and a brace attaching surface 62. The abutment surface 60 of the first projecting leg 48 serves to restrain the associated horizontal beam 14 against movement in the blocked direction parallel to the wall of the building frame 10. The next adjacent vertical column 12 includes a similar abutment surface 60 to prevent the horizontal beam 14 from sliding in the opposite direction along the wall. Consequently, the length of each horizontal beam 14 is substantially the same as the distance between adjacent pairs of the vertical columns 10.

The brace attaching surfaces 62 of the first projecting legs 48 are in opposed relation and serve as anchor points for the braces 28 which extend into the alley 54 between the legs. Through the securement of the opposed brace attaching surfaces 62 to a common brace 28, the angle irons 46 are fixed relative to each other.

With the structural configuration of the first upstanding member 24 as defined by the adjacent angle irons 46 as background, the support clip 40 in its operative environment will be described in more detail. Referring again to FIG. 4A, the clip 40 is defined by a plate 64 and an associated flange 65. The plate 64 is oriented perpendicularly to the flange 65 and transitions thereto through a fillet 66. The support clip 40 illustrated in FIG. 4A is shown supporting horizontal beams 14 that are formed as inverted U-shaped metal extensions. The metal extension-type horizontal beams 14 preferably each include a flat 67, a depending margin 68 joined to each side of the flat and an in-turned tab 69 at the end of each margin. The metal extensions are preferably formed from aluminum for optimum weight and which resists bending in the inverted U-shaped position to a greater extent than if the shape were reversed.

The clip 40 is attached to the abutment surfaces 60 of the first projecting legs 48. To accommodate the first projecting legs 48 of the angle irons 46, a cut-out portion 70 is formed in the clip 40. The clip 40 used to support the metal extensions has the cut-out portion 70 adjacent to, and extending along the plate 64 a distance from, the fillet 66. The cut-out portion 70 also extends through the fillet 66 and through the flange 65. Consequently, the cut-out portion 70 creates a split flange 65 defined by a first flange portion 65*a* and a second flange portion 65*b*. Since the cut-out portion 70 is preferably formed along the center line of the plate 64, the flange portions 65*a*, 65*b* are of substantially equal dimension.

In the operative environment, the flange portions 65*a*, 65*b* project downwardly adjacent the contact surfaces 58 of the angle irons 46*a*, 46*b*, respectively. The flange portions 65*a*, 65*b* serve as load-bearing members for each of two adjacent metal extension-type beams 14.

More specifically, the plate 64 mutually supports end sections of the flats 67 of opposing beams 14 cantilevered from the projecting legs (48) of the outer web of the truss. With reference to the beam 14 adjacent to the angle iron 46*a*, the outer depending margin 68 of the metal extension-type beam 14 slides into the opening between the adjacent contact surface 58 and the flange portion 65*a*. The in-turned tab 69 on the outer depending margin 68 curls under the edge of the flange portion 65*a*. It is thus recognized by those skilled in the art that the flange portions 65*a*, 65*b* retain the metal extension-type beam 14 against anticipated wind forces exerted against the finished exterior walls 30.

The clip 40 shown in FIG. 4B is an alternate embodiment that is used with horizontal beams 14 that take the form of wood boards such as 2×4. Similar to the previously described embodiment, the clip 40 is defined by a plate 64 that transitions through a fillet 66 to a flange 65 that is oriented perpendicularly to the plate. In order to accommodate the spaced first projecting legs 48, a cut-out portion 70 is also formed in this embodiment of the clip 40. Here, however, the cut-out portion 70 is formed at an edge of, and extending a distance into, the plate 64 opposite the flange 65. Here again, the cut-out portion 70 is preferably formed along the center line of the plate 64.

The cut-out portion 70 on this clip embodiment thus defines opposing plate segments 72*a*, 72*b*. In operative position, the plate segments 72*a*, 72*b* are attached to the abutment surfaces 60 of the first projecting legs 48. The preferred support clip 40 of this embodiment is oriented so that the flange 65 projects upwardly from the plate 64.

The plate 64 supports end sections of opposing wood-type horizontal beams 14 between respective contact surfaces 58 of the second projecting legs 50 and the flange 65. It will again be appreciated that the flange 65 serves as a load-bearing member for wind forces exerted against the exterior wall 30 of the finished building.

Figure 5A:
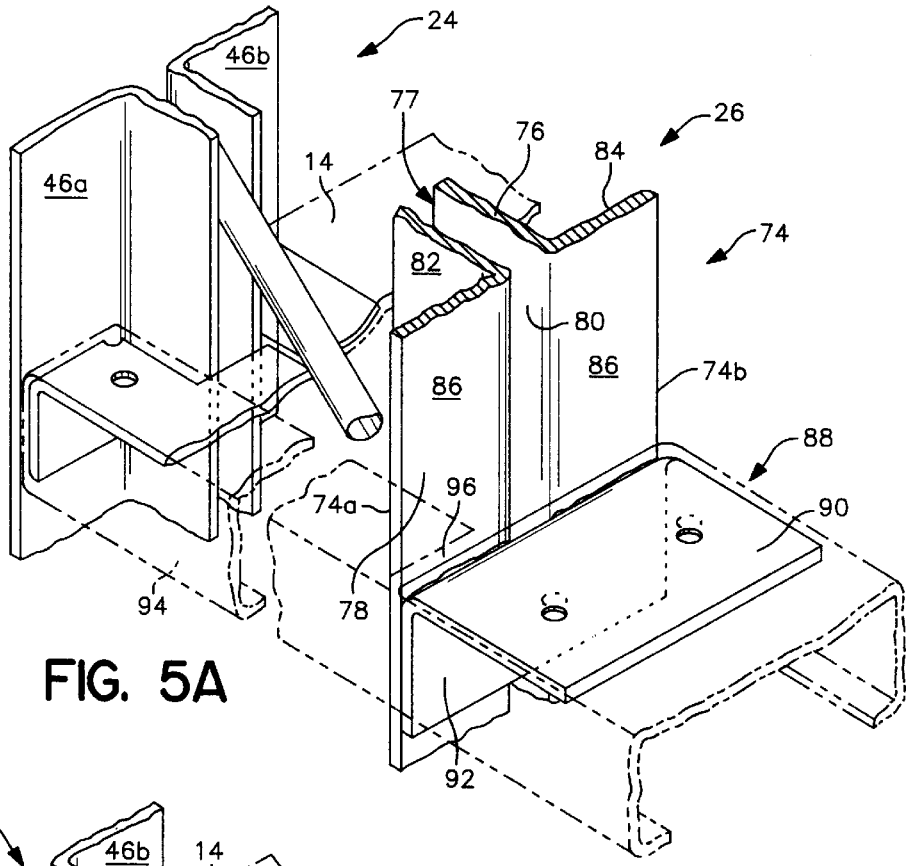
FIG. 5A shows the first and second upstanding members, partially broken away, of a corner vertical column and the endwall horizontal beam as contemplated by one embodiment of the present invention.
Figure 5B:
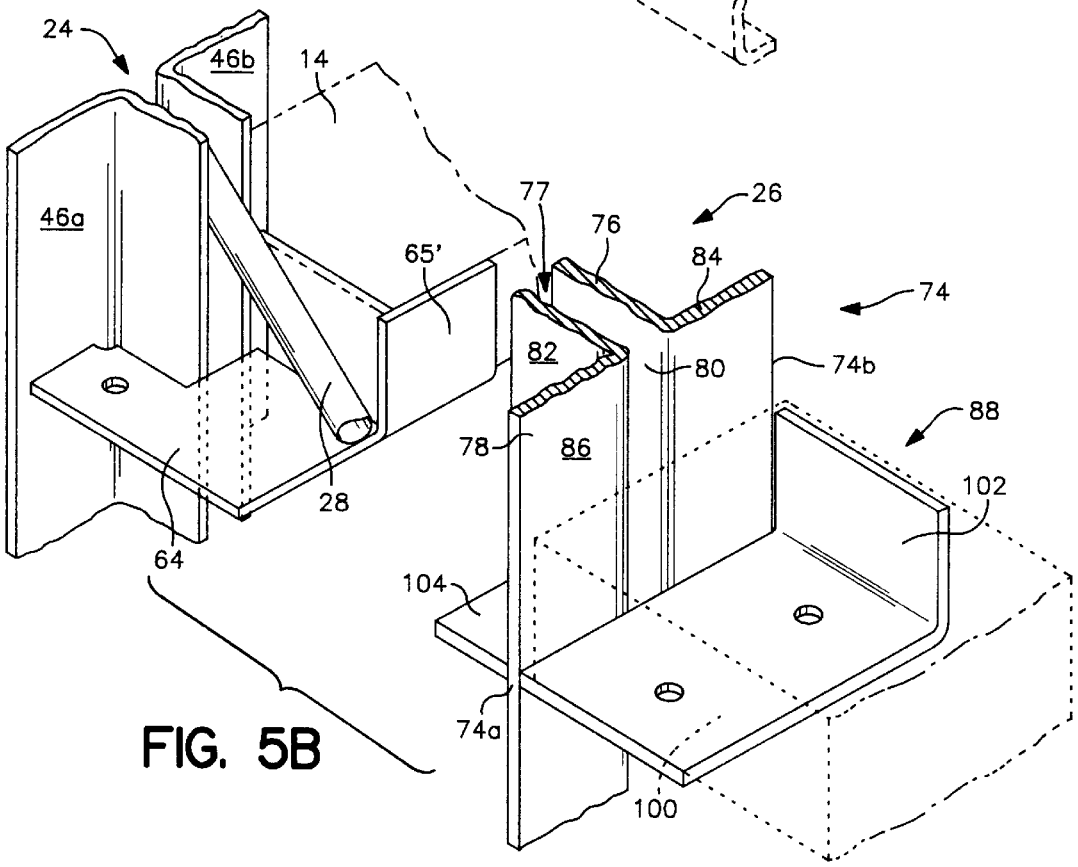
FIG. 5B is a view similar to FIG. 4A, but showing an alternative embodiment of the present invention.

FIGS. 5A and 5B illustrate the cooperating relationship of horizontal beams 14 and the corner vertical column 12. The nature of these drawing figures also affords the opportunity to illustrate the association between the first upstanding member 24 and the second upstanding member 26 of the vertical column 12.

As can be seen from FIGS. 5A and 5B, the second upstanding member 26 also comprises a pair of angle irons 74. Here again for purposes of distinction, the leftmost angle iron of the second upstanding member 26 is identified by numeral 74*a* and the rightmost angle iron is noted as 74*b*. Referring still to the angle irons collectively as 74, each has a first projecting leg 76 and a second projecting leg 78. The first projecting legs 76 of the angle irons 74 project in parallel and in alignment with and towards the first projecting legs 48 of the angle irons 46. The spaced nature of the first projecting legs 76 of the angle irons 74 define an alley 77 for receiving the braces 28. The first projecting legs 76 have opposed brace attachment surfaces 80 to which the braces 28 are attached, i.e. through weldment. As with the angle irons 46, the attachment of the braces 28 to the opposed brace attachment surfaces 80 fix the angle irons 74*a*, 74*b* in relative stationary position.

Referring now particularly to the angle iron 74*a*, it is also defined by an abutment surface 82 on the first projecting leg 76 and a contact surface 84 on the second projecting leg 78. The abutment surface 82 and contact surface 84 of the angle iron 74*a* serve similar purposes as the like surfaces on the angle irons 48 of the first upstanding member 24 as is further described below.

The angle irons 74*a*, 74*b* both have bracket attachment surfaces 86 on their second projecting legs 78. The bracket attachment surfaces 86 are substantially aligned with one another and define attachment sites for a corner column endwall bracket 88 as is further described below.

With specific reference to FIG. 5A, the bracket 88 is defined by a plate 90 and a down-turned flange 92. The down-turned flange 92 is welded to the bracket attachment surfaces 86. The plate supports the inverted U-shaped metal extension that forms a horizontal beam 14 along an endwall 18 of the building frame 10. One can also identify the horizontal beam 14 that extends from the first upstanding member 24 of the corner column 12 along the sidewall 16 in the direction away from the near endwall 16.

In the preferred embodiment of the invention, a corner beam 94 is defined to extend between the contact surface 58 on the angle iron 46*a* and the contact surface 84 on the angle iron 74*a*. The corner beam 94 is supported adjacent to the first upstanding member 24 by the support clip 40 attached thereto. A half plate (not shown) is fixed to the abutment surface 82 of the angle iron 74*a* to provide support for the opposite end of the corner beam 94 adjacent to the second upstanding member 26.

The corner beam 94 may be formed as a separate discrete component and fixed to both or either of the support clip 40 or the half plate previously described. Alternatively and preferably, the corner beam 94 is an integral extension of the endwall beam 14. The corner beam 94 is formed in the latter instance by cutting away a lateral portion of the end of the metal extension-type beam 14 to create a section of sufficient length and width to fit between and within the area defined by the contact surface 58 and abutment surface 62 of angle iron 46*a* and the contact surface 84 and abutment surface 82 of angle iron 74*a*. A slot 96 is cut along the flat 67 at its junction with the depending margin 68 to accommodate the second projecting leg 78 of the angle iron 74*a*. In this fashion, the corner beam 94 and the adjacent endwall beam 14 form a continuous member.

FIG. 5B illustrates the configuration of the corner vertical column 12 that is contemplated for use with wood-type horizontal beams. A similar corner column endwall bracket 98 is attached to the bracket attachment surfaces 86 of the angle irons. The bracket 98 has a plate 100 for supporting the endwall horizontal beam 14 and an up-turned flange 102 extending from the plate. The up-turned flange 102 is situated adjacent to the second projecting leg 78 of the angle iron 74*b*. With this configuration, the up-turned flange 102 serves as a retaining and load-bearing member for the endwall wood-type horizontal beam 14.

The support clip 40 that is attached to the first upstanding member 24 is modified from that described above for use in supporting the sidewall wood-type horizontal beam 14 at the corner vertical column 12. More specifically, since the last sidewall beam 14 extends only to the angle iron 46*b* of the corner vertical column 12, only a portion of the flange 65 is required to retain the sidewall beam 14. The support clip 40 for the corner vertical column is thus preferably formed with a partial flange identified as 65' in FIG. 5B.

The corner vertical column 12 illustrated in FIG. 5B is shown without a corner beam between the first upstanding member 24 and the second upstanding member 26. A corner beam may be provided, if desired, and when included, is supported adjacent to the angle iron 74*a* by a half plate 104 attached to the abutment surface 82. An appropriately sized block may be cut to fit between the first upstanding member 24 and the second upstanding member 26 and supported upon the plate 64 of the clip 40 and the half plate 104. The modified support clip 40 allows the placement of the corner beam in view of the absence of the portion of the flange removed to create partial flange 65'. It can be visualized that the abutment surface 60 of the angle iron 48*a* and the abutment surface 82 of the angle iron 74*a* serve as load-bearing members for the corner beam.

Artisans will recognize that the use of the components described above promotes the practice of an improved method of building construction. The individual components of the building frame 10 are formed in accordance with the description above and transported to the building site. The vertical columns 10 and horizontal beams 14 are cooperatively assembled and fixed together, along with the roof components not described as part of the invention, to form the rigid building frame 10. Once the building frame 10 has been completed, the building may be finished as desired.

In summary, numerous benefits result from practicing the teachings of the present invention. The horizontal beams 14 are cooperatively positioned between associated adjacent pairs of vertical columns 12 so that the outer facing surfaces 36, 38, respectively, are substantially aligned with one another. This allows the frame border of the building frame 10 to be defined by the outer facing surfaces 38 of the vertical columns 12 in combination with the outer facing surfaces 36 of the horizontal beams 14. This result is promoted by the use of support clips 40 that each cooperatively attach to the first upstanding member 24 of the vertical column 12 to support the horizontal beams 14 in the desired positions. The use of the inventive components in practicing the method of building construction achieves the desired goal of reduced material requirements and increased asset value as a result of increased usable internal area for a given frame size.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. A building construction having external cladding forming the exterior walls supported by interior vertical columns spaced apart by horizontal beams defining an interior framing system, the improvement comprising:

a support clip engaging with each of said vertical columns for supporting the horizontal beams, each of the horizontal beams having opposite ends and extending between adjacent vertical columns in partially abutting relationship at the opposite ends with said vertical columns, each said vertical column having an outwardly facing flat leg in abutting and supporting relationship with the external cladding and an inwardly directed vertical flat leg in a plane perpendicular to said outwardly facing flat leg in mutually abutting relationship with the ends of adjacent beams extending between the columns, and each said support clip having a horizontal flat body portion cantilevered from said inwardly directed vertical flat leg of each column and extending in mutually supporting relationship to each of the ends of said adjacent beams, and each said support clip having a flange perpendicular to the flat body portion opposite the outwardly facing flat leg of the column and mutually supporting said adjacent beam ends for retaining the beams in position between said flange and said outwardly facing flat leg in substantial abutting relationship with the cladding whereby the framing system is rapidly assembled and uses fewer vertical columns owing to the cantilevered support clips tying the beams and columns together.

2. The improvement of the building construction as set forth in claim 1 wherein:

each vertical column has an L-shaped leg in horizontal cross section with the outwardly facing flat leg portion abutting the cladding and the inwardly directed vertical flat leg portion being in mutually supporting relationship with the adjacent beam ends, each said horizontal beam having a U-shaped transverse cross section, the ends of adjacent beams being mutually supported by each said column, and each said support clip having a slot in the horizontal flat body portion into which the inwardly directed flat leg of each column is received for attachment of each clip in cantilever fashion to the vertical column.

3. The improvement of the building construction as set forth in claim 2, wherein said flange is spaced inwardly from the outwardly facing flat leg portion columns and extends perpendicular from said flat body portion of the clip defining a narrow space, each beam being inverted with the U-shaped cross section opening downwardly and having an outer marginal portion thereof depending into said narrow space.

4. The improvement of the building construction as set forth in claim 2 wherein the flange is spaced inwardly a width of the beam, and extends upwardly behind the beam and the flat body portion extends below a bottom surface of the beam in mutually supporting relationship with adjacent beam ends.

5. The improvement of the building construction as set forth in claim 3 wherein said flange is on opposite sides of the slot and is spaced from the outwardly facing flat leg portion of the L-shaped column leaving a narrow space on opposite sides thereof, and the adjacent beams are lengths of U-shaped channel inverted with a marginal portion dependent from the adjacent ends being received in mutually supporting relationship with the flange on opposite sides of the slot.

6. A framing system for an exterior wall having a plurality of panels fastened to an interior frame comprising a plurality of laterally spaced column supports, a plurality of transversely extending beams having their opposite ends in partial abutting relationship with adjacent column supports, each of said column supports having a transverse cross section at the location where the ends of the beams are in partial abutting relationship in which said column supports define a first flat leg portion extending laterally adapted to be in substantial abutting relationship with an exterior wall panel and a second flat leg portion extending inwardly from the first flat leg portion and partially abutting in relationship with the adjacent ends of each beam, each beam having a vertical transverse cross section adjacent each end defining a depending margin at one edge, a support clip having a flat plate portion and a depending flange portion, the flat plate portion being secured to the second flat leg portion of the column supports such that the depending flange portion is spaced opposite the first flat leg portion to receive said depending margin thereby supporting in cantilever fashion each end of the beam.

7. A framing system as set forth in claim 6 wherein each column support has an L-shaped transverse cross section defining said first and second flat leg portions in partially abutting relationship with adjacent ends of each beam.

8. A framing system as set forth in claim 7 wherein each support clip has a slot in said flat plate portion into which is inserted said second flat leg portion for securing the clip thereto in cantilever fashion, and said depending flange portion which extends from said flat body portion spaced from said first flat leg portion is sufficient to receive the adjacent margins of successive beams in partial abutting relationship with said second flat leg portion, each end of said adjacent beams being mutually supported on said flat body portion of the clip.

9. A framing system as set forth in claim 8 wherein the flange extends from the flat plate portion on each side of the slot and is narrowly spaced from the first flat leg portion, each beam having an inverted U-shaped cross section in which the depending margin extends into said narrow space tying the beams in cantilever fashion at opposite ends to each support column such that the resistance to bending is enhanced.

10. A framing system as set forth in claim 9 wherein each column has an outwardly facing web portion defining said first flat leg portion and an inwardly directed leg portion defining said second flat leg portion, said U-shaped beams being metal channels, the adjacent opposite ends of said U-shaped beams abutting the inwardly directed leg portion and being mutually supported by the flat plate portion of said support clip in cantilever relationship from the depending flange of the support clip.

* * * * *